United States Patent [19]

D'Aragon

[11] 4,260,482

[45] Apr. 7, 1981

[54] TWO STAGE GRAVITY METHOD OF CONCENTRATION OF FINE DRY MATERIALS

[76] Inventor: Paul D'Aragon, 21 St. Jacques, St. Sauveur des Monts, Quebec, Canada, J0R 1R0

[21] Appl. No.: 78,008

[22] Filed: Sep. 24, 1979

[51] Int. Cl.[3] ..... B07B 13/08

[52] U.S. Cl. ..... 209/480; 209/432

[58] Field of Search ..... 209/470, 485, 479, 480, 209/428–433

[56] References Cited

U.S. PATENT DOCUMENTS

| | | | |
|---|---|---|---|
| 280,934 | 7/1883 | Kent | 209/433 |
| 1,033,219 | 7/1912 | Wall | 209/431 |
| 2,421,397 | 6/1947 | Stewart | 209/433 |
| 3,744,632 | 7/1973 | Mozley | 209/433 |

*Primary Examiner*—Ralph J. Hill

[57] ABSTRACT

The two stage gravity method of concentration of fine dry materials makes use of the differences in the specific gravity of the materials by using principles fairly similar to those used in wet shaking table. The dry materials are loaded in a continuous series of troughs as they pass successively underneath a loading means as they travel conveyor belt like in a close circuit and, as they travel they are firstly submitted to a series of cyclic directed shaking motions transversal to the troughs and secondly, to a series of similar cyclic shaking motions parallel to the long axis of the troughs, the whole resulting in the production of a concentrate, and of middlings and waste which are unloaded in suitable receivers as the troughs turn downward in their conveyor belt like circuit.

4 Claims, 5 Drawing Figures

TWO STAGE GRAVITY METHOD OF CONCENTRATION OF FINE DRY MATERIALS

The proposed method of concentration has for its aim the production of a concentrate or concentrates of a material or materials from a mixture of materials and, more especially when applied to ores, the separation of the valuable elements from the gangue.

The method of concentration will have special application in the treatment of ores which have to be ground to a great degree of fineness to liberate the valuable elements or, ores in which the valuable elements are friable and which when ground reduce the said elements to rather fine particles.

The method would apply to most ores which are not effectively concentrated by the usual methods of flotation or gravity and, and it would apply to such ores, as tantalite, pyrochlore, uranium oxydes, etc.

The method of concentration has its basic principle the separation according to the specific gravity of the materials treated, being given in most cases a certain preliminary classification.

The method makes use of principles fairly similar to those used on wet shaking tables, except that it is used with dry pulverized ores and that the said dry pulverized ores are carried by troughs, while in the wet tables water is the carrier. The cyclic shaking motions which will effect the concentration in our method are similar in all points to those used in the wet shaking tables and, their basic theory is found in most textbooks on or dressing and, well known to all leanred in that art.

The troughs can be made with many shapes. A preferred cross section would be that of an open elongated box with an horizontal or inclined bottom, with or without rifles.

In order to facilitate the concentration, the troughs are divided in a series of compartments by partitions extending from the open top to the bottom, except that a hole properly shaped is left at the bottom of the partitions against one of the wall of the troughs, so as to permit a small connection between two adjacent compartments.

At the loading end, one or more compartments are suitably loaded with pulverized ores and, as the troughs travel, conveyor belt like, they are firstly submitted to a series of cyclic shaking motions directed at right angle to the long axis of the troughs, shakings which will concentrate the elements of high specific gravity in a bar like deposit at the bottom against one wall of the troughs, while the continued shakings will pile up the lighter elements over the said higher gravity elements.

Secondly, the troughs will be submitted to a series of cyclic shaking motions parallel to the long axis of the troughs, shakings which will gradually push the elements of higher specific gravity away from the overlying lighter elements into convenient compartments.

As all the troughs travel conveyor belt like in a closed circuit, at the end of their travel in a plan, as they curve downward in a half of a circle, they will unload in convenient receivers, waste, middlings and concentrates.

DETAILED DESCRIPTION OF THE DRAWING

Figure 1:
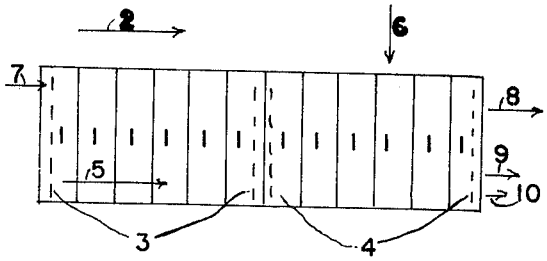
FIG. 1 is a plan view schematically representing a series of parallel troughs connected side-to-side in a conveyor belt which runs from left to right.

FIG. 1 shows a continuous series of troughs 1 all travelling conveyor belt like in the same direction as per arrow 2, the said troughs 1 being conveniently loaded with the pulverized mixture of materials by suitable means as per arrow 7 and then as they travel over a mechanism in the area 3, they are submitted to a continuous series of cyclic shaking motions as per arrow 5, at right angle to the long axis of the troughs 1, shakings which will cause the particles of higher specific gravity to concentrate in a bar like deposit underneath those of lighter gravity against one wall of the troughs 1 and, as the said troughs 1 travel further as per arrow 2, they are submitted to another continuous series of cyclic directed shaking motions over a mechanism in the area 4, shakings directed as per arrow 6 which is about parallel to the long axis of troughs 1, shakings which will push and separate the elements of higher specific gravity away from those of lighter gravity.

As the troughs turn downward in a half of a circle, not shown, they discharge their content as per arrow 8, waste, as per arrow 9, middlings, and as per arrow 10 a concentrate.

Figure 2:
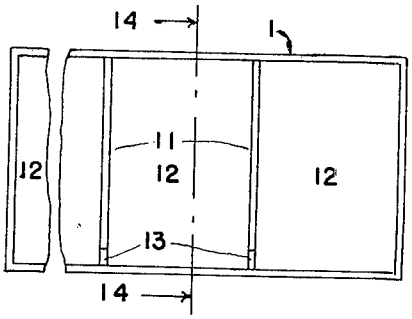
FIG. 2 is a plan view of a trough divided into a series of compartments.

FIG. 2 shows trough 1 divided into a series of compartments 12 by a series of partitions 11. The partitions 11 have a suitable hole 13 against one wall so as to leave an opening adjacent compartments 12.

Such a hole 13 will prevent the spreading of the waste during the concentration, therefore facilitating the obtention of a better concentrate.

Figure 3:
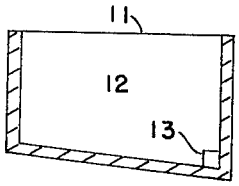
FIG. 3 is a section of a trough taken along line 14—14 in FIG. 2.

FIG. 3 shows a partition 11 and a suitable hole 13 between two adjacent compartments 12.

Figure 4:
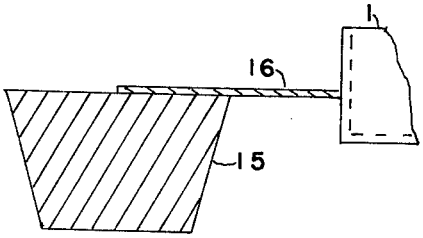
FIG. 4 is a section showing a means of joining the end of a trough to a V-belt.

FIG. 4 shows a means of driving the series of troughs 1 conveyor belt like, the said troughs 1 being linked on both sides ends, only one end shown, to V-belts 15 by suitable elastic means 16.

The elastic means 16 could be made of ribbons of rubber or again by suitable metal springs.

Figure 5:
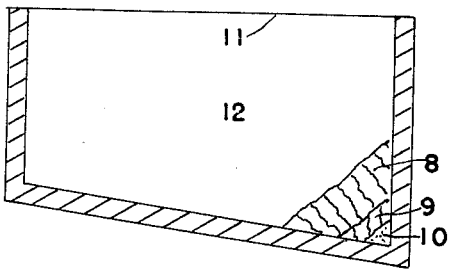
FIG. 5 is an enlarged section of a trough showing superposed layers of concentrates, middlings and waste (bottom to top respectively) against one wall of the trough.

FIG. 5 shows a compartment 12 of a trough 1 where at the end of a series of cyclic directed shaking motions transversal to the long axis of the trough 1, a bar like deposit of a concentrate 10 forms at the bottom resting under deposit 9 of middlings and, on top of said middlings, a sheet like deposit 8 of the elements of smaller specific gravity.

The present form of apparatus has been used only as an illustration of the application of our method of concentration and, it is certain that the dimensions and the shapes of the troughs, the shapes and the dimensions of the holes connecting the compartments may vary. Likewise, the bottom of the troughs can be horizontal or inclined, with or without riffles, the movement of the troughs continuous or cyclical shaking motions might be produced by mechanical means or by electric induction.

The embodiments of the invention in which an exclusive property or privilege is claimed are defined as follows:

1. A two stage method of concentration of fine dry materials according to specific gravity comprising: feeding the dry materials to one end of a series of troughs connected side-to-side with parallel long axes to form a conveyor belt, moving said series of troughs in a closed circuit, shaking the troughs at a first location with a series of cyclic shaking motions directed parallel to the movement in said closed circuit, thereby producing a concentration of materials of higher specific gravity in a deposit beneath at least one layer of material of lesser specific gravity, said deposit being located at the bottom and against a longitudinal wall of each trough, shaking the troughs as they further travel in a series of cyclic shaking motions directed parallel to the long axes of the troughs at a second downstream location to thereby cause said deposit of higher specific gravity to move parallel to said long axes in the troughs differentially from those of lesser specific gravity materials into suitable receivers as the troughs move downwardly in a half circle in their closed circuit.

2. A method according to claim 1 wherein the troughs are divided into compartments.

3. A method according to claim 2 wherein openings are provided between adjacent compartments within a single trough.

4. A method according to claim 3 wherein the bottom of the compartments are provided with riffles.

* * * * *